United States Patent [19]

Saxon

[11] 4,211,752

[45] Jul. 8, 1980

[54] HINGED LOAD DUMPING DOOR FOR MULTI-CELL EXTRACTORS

[75] Inventor: Arthur F. Saxon, Pittsburgh, Pa.

[73] Assignee: Dravo Corporation, Pittsburgh, Pa.

[21] Appl. No.: 916,205

[22] Filed: Jun. 16, 1978

[51] Int. Cl.[2] ..... B01D 11/00

[52] U.S. Cl. ..... 422/268; 422/269; 422/270; 198/704

[58] Field of Search ..... 422/261, 268, 269, 270, 422/272, 275, 267; 127/6; 198/704

[56] References Cited

U.S. PATENT DOCUMENTS

| | | | |
|---|---|---|---|
| 2,840,459 | 6/1958 | Kornofsky | 422/268 |
| 3,533,837 | 10/1970 | Strich | 422/269 |
| 4,125,379 | 11/1978 | Saxon | 422/269 |

*Primary Examiner*—Joseph Scovronek
*Assistant Examiner*—Chris P. Konkol
*Attorney, Agent, or Firm*—Parmelee, Miller, Welsh & Kratz

[57] ABSTRACT

A multi-cell apparatus for the solvent extraction of oils or juices from divided organic material and like operations wherein a circular series of open top cells is radially disposed for rotation about a vertical axis with a bottom door hinged to the lower end of each cell comprised of a perforate bottom panel carried on a rigid frame and which is normally held closed against the lower end of its cell, but which swings downwardly by the removal of support at both the inner and outer ends of the door at a predetermined station in the circle of rotation of the cells for the discharge of spent material in turn from each cell preparatory to the door being again closed. Each door, as herein disclosed has a diagonal structural frame member under the perforate bottom, so arranged, in effect, to divide the door into two complementary triangular areas of unequal area in such manner that the weight of the load of material in the cell above one triangular area overbalances the weight over the complementary area whereby the usual support for the inner end of each door is eliminated other than the usual hinge arrangement.

6 Claims, 3 Drawing Figures

HINGED LOAD DUMPING DOOR FOR MULTI-CELL EXTRACTORS

This invention is for a hinged door designed to form the bottom of a vertical cell or compartment used to hold a load of bulk material that is retained in the cell for a period of time and then discharged by freeing the hinged door to swing downwardly and thereby open the bottom for releasing the load.

The invention is particularly applicable to and adapted for use with an extraction type of apparatus as disclosed in U.S. Pat. No. 2,840,459 issued June 24, 1958 on the application of George B. Karnofsky, but is applicable to other material handling or processing apparatus wherein a bulk material is progressively charged into a succession of cells and subsequently discharged at a different station from the loading station or perhaps even discharged at the same station. It will be herein specifically described for purposes of simplicity as an improvement in the type of apparatus described in said Karnofsky patent.

The apparatus of the Karnofsky patent, widely sold and known in the industry under the trademark "Rotocel," is typically used for the extraction of oil from crushed seeds, soy bean flakes, or other chopped or comminuted vegetable material where the raw bulk material, after being prepared for processing, is placed in a cell and a solvent percolated through it. The bottom of the cell supports the material but is of a perforate or screen-like nature through which the miscella may drain and after a period of time when further extraction has ceased, the bottom opens and the now spent bulk material drops from the cell and is removed from the machine.

As presently constructed, the machine has a circular series of like cells arranged about and spaced outwardly from but connected with a central vertical shaft. Each cell is formed with a pair of spaced side walls that are radial to the axis of the shaft, with an inner wall or panel joining the inner edges of the pair of side walls. Similarly, the outer edges of each pair of side walls are joined to an outer wall or panel, but, because of the side walls each being radial to the axis of the vertical shaft, the cells are wider at the periphery of the structure than they are at the inner or what may be termed the back wall. In other words, as seen in a top plan view, each cell is of a trapezoidal shape throughout its depth.

Since the machines are usually designed to process many tons of bulk material an hour, they are massive with each cell being many feet deep and several feet in length radially, that is, from front to back.

Commonly, the central shaft is motor driven and the annular series of closely spaced cells constitute a rotor that is driven in one direction over a stationary base structure that provides an annular disposed series of troughs or trays into which the miscella drains through the perforate area of the cell bottoms and there are pumps that recirculate the miscella of increasingly rich extract content from an initial solvent input station from cell to cell in a direction opposed to the direction of rotation of the rotor. There is one compartment or trough, however, in this annularly disposed series in the base into which the spent material from which the oil has been extracted is discharged and removed from the machine. There is also a fixed enclosure surrounding the rotor.

As above explained, each cell has a perforate door at the bottom which is normally in a horizontal or closed position but which is hinged at that edge of the bottom of the cell side wall which, in respect to the direction of the rotation of the rotor, is the trailing or following side wall.

Heretofore, the bottom door of each cell has been supported by hinges along one edge secured to the bottom edge of the trailing side wall of the cell. The other side edge of the door has a roller at each end thereof at the two leading corners of the door. The roller at the outer or peripheral end normally rolls on a supporting track around the inside wall of said stationary outer enclosure. The corresponding edge at the inner end of each door also has a roller that rolls on a circular inner track fixed on the stationary base. At that station where the contents of the cell are to be dumped, both of these tracks have a gap or break in them where the rollers cease to have support, allowing the door to swing suddenly downward to discharge the contents of the cell to drop from the cell. As thr travel of the rotor continues, the rollers are guided up an inclined ramp back onto the respective tracks beyond the break in the tracks to again close the bottom of the now empty cell so that it will receive and hold a fresh charge of bulk material.

It would be expected that both rollers would simultaneously reach the break in their respective tracks, but the geometry of the construction requires that, because of its shorter arc of travel, the roller on the inner end of each cell must clear the inner track before the outer roller reaches the gap in the track along which it rolls. The rotor, of course, moves slowly so that there is an interval of time in which the then unsupported corner of the bottom must resist the weight of the bulk material in the cell, creating a torque or twisting force on the bottom until the roller at the outer end also rides off the break in its track to remove all support for the leading edge of the door allowing the door to swing on its hinges suddenly downward.

In addition to the necessity of making the doors strong enough to resist this twisting force at every revolution of the rotor, the field work of assembling and leveling the inner track relative to the base and to the outer track is time-consuming and difficult and imposes on the purchaser added cost and maintenance expenses.

The present invention provides an improved door construction for apparatus of this general type which eliminates the inner track and roller and wherein the door has at all times, except when dumping, a three point support, utilizing but one roller that is, as now, on the leading peripheral corner of the door and but one track which, as now, is carried on the inside wall of the fixed enclosure. To this end, the door, as before, of each cell is hinged to swing in a vertical arc from the bottom edge of its trailing side cell wall but, according to this invention, it is provided with a rigid structural support extending diagonally from the hinged inner corner of the trapezoidal door to the diagonally opposite corner at the outer end of the door, and there is a wheel or roller at only this outer corner. This roller and the track on which it rolls supports the door in the closed position except at the place or places in the track where there is a break or gap in the track to provide for the opening of the door. This structural member on the underside of the door, in effect, divides the area of the trapezoidal shaped door into two triangles. Because of the trapezoidal shape of the door, the triangle that has one side hinged to the side wall is greater in area than the second complementary triangle having its wider end at the narrower end of the cell. Thus, the weight of the load on the bottom is distributed on the two sides of the diagonal structural member but the weight on the larger triangular area overbalances the weight on the smaller triangle and the forces tending to twist or distort the bottom at the inner end, which no longer has any supporting wheel at all, is counteracted by the overbalancing or unequal distribution of the weight or load over the two triangular areas of the cell bottom.

The invention may be more fully understood by reference to the accompanying drawings showing a preferred embodiment of my invention and in which.

Figure 1:
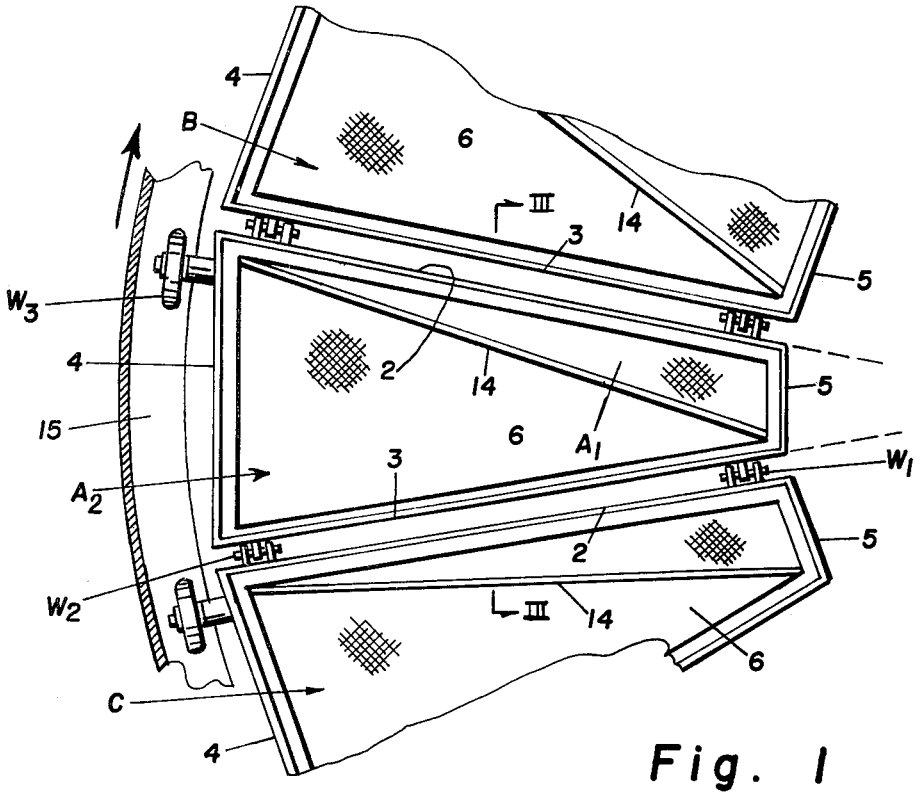
FIG. 1 is a fragmentary plan view of a portion only of the rotor showing one cell and portions of the cells between which this one cell is located.
Figure 2:
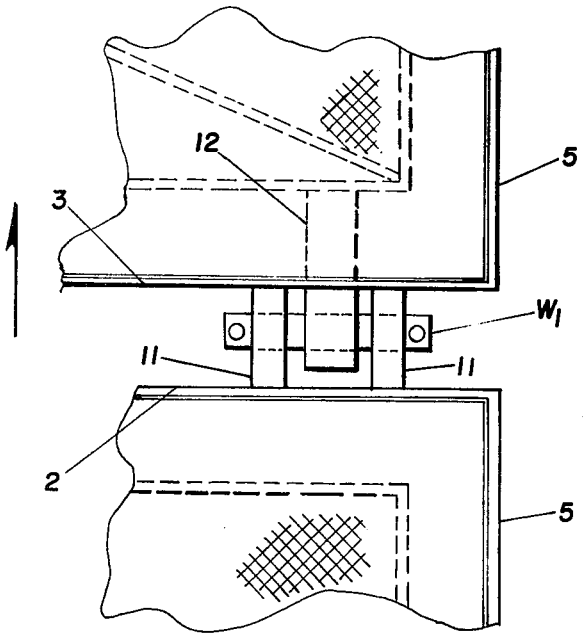
FIG. 2 is a fragmentary plan view on a larger scale than FIG. 1 of a single hinge connection between the door and the fixed lugs at the side of the bin providing the pivotal attachment of the connection to the bin between the trailing wall of the bin and the leading wall of the following bins, the fragment here shown being the portion near the inner end of the door.

Since the present invention is for an improvement applicable to each individual cell, and more especially to the bottom door construction, a complete continuous rotating extractor has not been shown, but only one complete cell of an annular series comprising the rotor of the extractor is shown along with fragments of a similar cell at each side, as shown in FIG. 1. For purposes of illustration, it may be assumed that the rotor turns clockwise, as indicated by the arrow in this and the other figures. Looking down at the rotor, one sees the top edges of the two side walls of the cell A, to one side of which is a portion of the cell ahead B, and trailing cell A is a portion of the cell C immediately following A.

Referring first to FIG. 1, which represents that portion of the rotor here shown as it appears from directly above the rotor, the top edges of the side and end walls of the cells are shown as two closely spaced parallel lines. The side wall 2 is the leading side wall of each cell with respect to the direction of rotation of the rotor and 3 is the trailing side wall. The outer or peripheral walls are designated 4, and 5 designates the inner walls of the cells. Each such four-sided cell has its side walls radial to the axis of rotation of the rotor, as seen by the broken projection lines in FIG. 1. As a result, each cell is wider at its outer end than its inner one, so that the cells as seen in FIG. 1 are of trapezoidal shape. The side walls of adjacent cells are parallel one to the other, both being parallel to a common radial line located midway between the cell walls and passing through the exact center of the supporting rotor shaft.

Figure 3:
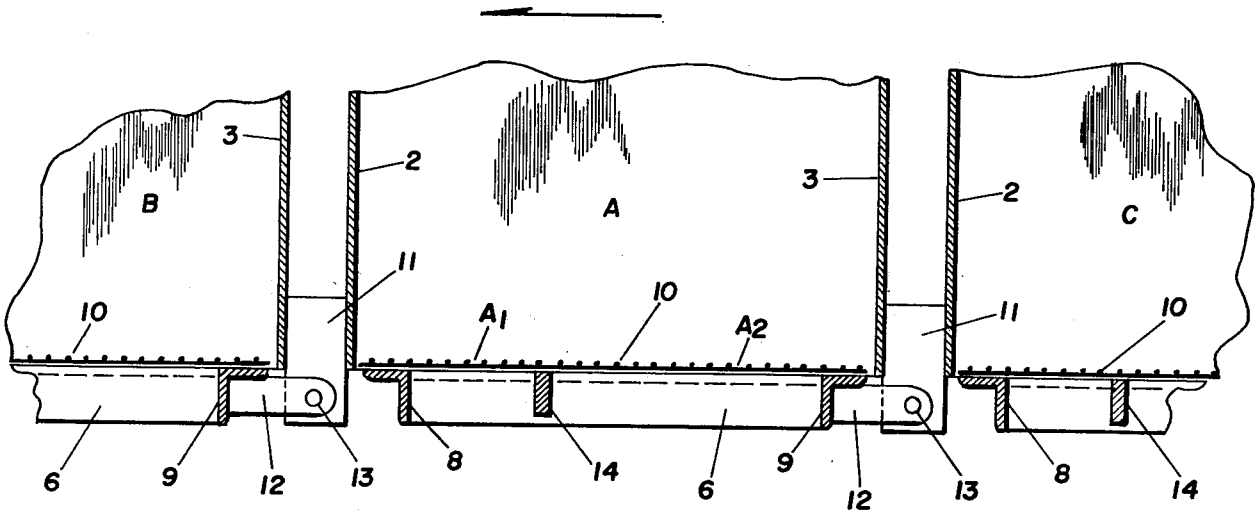
FIG. 3 is a fragmentary transverse section in the plane of line III—III of FIG. 1, but also on a larger scale.

There is a door designated generally as 6 at the bottom of each cell of trapezoidal shape and size to conform to the trapezoidal shape of the cell bottom and of a size to close the cell bottom. The door comprises a rigid frame which has side members 8 and 9, 8 being at the leading side edge of the door and 9 being at the trailing edge. The frame supports a perforated or reinforced wire screen bottom panel 10 covering the open area of the frame and indicated by the criss-crossed fragmental areas in FIGS. 1 and 3.

Between each two cell side walls 2 and 3 and welded or otherwise fixed to the leading wall 2 are two pairs of spaced lugs 11 projecting below the lower edge of the side walls. One pair of such lugs is near the outer periphery of the cells and the other pair near the innermost end of the cells. Hinge extensions 12 on the trailing side frame member project between the lower ends of the respective pairs of lugs, with a pivot 13 passing through each pair of lugs and the intervening hinge extension whereby one side of each door is hinged to swing in a vertical arc from the horizontal position shown in FIG. 3 downwardly, but each door frame has one side edge at all times rigidly supported by the hinges at its opposite ends at the bottom edge of the cell below which it is positioned. In FIG. 1, the hinge close to the innermost end of the door for cell A is indicated as $W^1$ and near the outer end of the door as $W^2$.

According to the present invention, a rigid structural member 14 is immovably secured to the door frame under the perforate bottom panel from the corner of the door frame nearest the hinge $W^1$ diagonally of the door to the outer corner of the door frame most remote from both hinges.

Two points of support for the door frame are provided by hinges $W^1$ and $W^2$ while a third point of support for holding the door in its closed position is by a wheel $W^3$ on that outermost corner of the door frame remote from both hinges. This roller normally rolls on a fixed track around the interior of an outer fixed enclosure, a fragment of this track being indicated at 15 and the side wall at 16, all being more fully shown and explained in said Karnofsky patent. The track 15, for at least one short arc about the travel of the rotor within the outer casing, is discontinuous to remove support for the wheel $W^3$ so that the single point of support for this corner and radial leading edge of the door is withdrawn, allowing the door to swing downward vertically and allow the contents of the cell to drop out. Following this opening of the cell, the rotation of the rotor wherein each cell is one of an annular series, moves up an incline to the level where it again moves onto the track preparatory to the cell receiving another load of material.

The diagonal structural member 14 enables any similar supporting roller and track as heretofore needed to be eliminated on the inner end of the door and relieves the distortion or torque tending to bend or twist the bottom as occurs without such support and does occur each time, when, as previously explained, the geometry of the structure requires the rolling support at the inner end of the door to first leave its track while the outer one still remains on its track. In other words, the diagonal structural member 14 on the door frame enables the door to be supported with no more than three points, two at the outer end of the door and the third at the hinges $W^1$ at the inner end of the cell on which the door is carried. It will of course be understood that additional hinge structures could be provided between $W^1$ and $W^2$, but this, in effect, merely distributes the lengths of the two points of support along the hinged side of the door, shortening the total space between them.

This is explained through the fact that the diagonal structural member 14 in effect provides an axis dividing the door into two triangular areas $A^1$ and $A^2$, with the area $A^2$ being substantially greater than the area $A^1$. Consequently, a much greater volume and weight of the bulk material loaded into the cell is supported over $A^2$, which area has the direct support of the two hinge points $W^1$ and $W^2$ and the roller $W^3$. The smaller triangle $A^1$ is then cantilevered about 14 as an axis and is greatly overbalanced by the load on the area $A^2$, as well as by the hinged connection $W^1$ of triangle $A^2$ with the fixed side of the preceding cell. In other words, the structural member 14 is in the position of a common hypotenuse of two complementary, substantially right-angle triangles of unequal area with the weight of the load in the cell above the door over the larger triangle being most remote from the inner end of the door overbalancing the weight on the smaller triangle at the inner end of the door and two points of a three-point support for the door being on said outer end of the door.

This solution to the problem which has existed and has been recognized since the Karnofsky continuous rotary extractors were first developed thus removes a long existing difficulty with such machines and the many modifications they have undergone but reduces the cost of building and the setting up for use at the place where they are installed and enables the door itself to be cheaper to assemble and install.

I claim:

1. A door of trapezoidal shape adapted to provide a normally closed bottom for a trapezoidal cell of substantially the same size and shape comprising:

(a) a rigid frame structure having two diverging side frame members and two parallel end frame members connecting the opposite ends of the side frame members whereby the end frame members are of unequal length;

(b) one of said side frame members having hinge means adjacent its opposite ends by means of which the frame may swing in a vertical arc of about 90° from a generally horizontal plane where the bottom of the cell is closed downwardly to an open position for the discharge of material in the cell;

(c) a bottom panel having its edges supported on said frame covering the trapezoidal opening defined by said frame members; and (d) a rigid structural member extending from and connected to that corner of the narrower end frame member nearest the hinged side of the frame and extending diagonally of the frame to an outer terminus at that corner of the wider end of the trapezoidal frame most remote from the hinged side of the frame.

2. The door defined in claim 1 wherein the said diagonally extending structural member is in the relation of a common hypotenuse dividing the area fo the frame into two opposed but complementary right angle triangles of unequal area, each having a longer side and a shorter side, the shorter side of the larger triangle comprising the wider end of the trapezoid and the shorter side of the smaller triangle comprising the narrower end of the trapezoid, the longer side of the larger triangle having hinge means adjacent in opposite ends for attachment to a fixed support, the door having a third supporting means adjacent that end of the shorter side of the larger triangle most remote from the longer side of the larger triangle and adjacent also to the terminus of the said structural member at the wider end of the trapezoid frame.

3. The door defined in claim 2 wherein there is a door support engaging means at the corner of the frame where said diagonal structural member terminates and providing the only support for that side of the door remote from the hinged side when the door is in cell closing position.

4. The door defined in claim 3 where said door supporting engaging means provides a roller arranged to roll on a supporting track when there is relative travel of the cell to which the door is used and the track.

5. A bottom door for use with a multi-cell continuous rotary extractor where a continuous succession of cells which are wider at one end than the other, being of trapezoidal shape, with a door at the bottom of each cell of substantially corresponding size and shape is hinged along one edge with respect to the following cell of the series whereby it may swing in a vertical arc to open and close the door, and there is a concentric track alongside the wider ends of the cells of the series and there is a roller on the wider end of the door positioned to roll on and be supported by said track when there is relative movement between the cells and the track, the track having a gap to allow each door to swing downwardly to dump the contents of the cell when its roller loses the support of the track as its encounters the gap, the invention wherein: the door has a rigid peripheral frame of trapezoidal shape having hinge points adjacent each end of one side thereof cooperating with fixed hinge points along the corresponding edge of the cell, the door frame supporting the edges of a bottom panel forming the bottom closure of the cell against which the frame is fitted, said frame characterized by a rigid structural member secured to the underside of the frame and extending diagonally of the frame from that corner of the narrower end of the frame where it joins the hinged side of the frame to the opposite corner in such position as to constitute the common hypotenuse of two opposed complementary triangles of unequal areas, the larger of which is bounded other than by the hypotenuse by the length of the hinged side frame member and the longer of the end frame members.

6. The door defined in claim 5 wherein there is a roller extending from said last named corner to roll on the surface of the track and provide the only support means for otherwise holding the door from swinging downwardly as long as the track supports the roller.

* * * * *